US006540371B2

(12) United States Patent
Franks

(10) Patent No.: US 6,540,371 B2
(45) Date of Patent: Apr. 1, 2003

(54) ARTIFICIAL PUMPKIN STEM

(76) Inventor: Leonard Franks, 3965 Stephens, Warren, MI (US) 48091

( * ) Notice: Subject to any disclaimer, the term of this patent is extended or adjusted under 35 U.S.C. 154(b) by 0 days.

(21) Appl. No.: 09/825,796

(22) Filed: Apr. 4, 2001

(65) Prior Publication Data

US 2001/0036069 A1 Nov. 1, 2001

Related U.S. Application Data

(60) Provisional application No. 60/196,691, filed on Apr. 13, 2000.

(51) Int. Cl.[7] ..... F21S 6/00

(52) U.S. Cl. ..... 362/122; 362/806; 362/808; 446/485; 446/71

(58) Field of Search ..... 362/122, 124, 362/806, 808, 186, 351, 361, 363, 408, 372; 428/22; 446/485, 484, 220, 73, 71, 76

(56) References Cited

U.S. PATENT DOCUMENTS 1,776,182 A * 9/1930 Cook ..... 40/555
3,610,917 A * 10/1971 Hunt ..... 362/540
3,997,686 A * 12/1976 McClure ..... 427/4
4,392,190 A * 7/1983 Upton ..... 362/281
4,802,071 A * 1/1989 Schuster ..... 362/154
5,297,013 A * 3/1994 Hall et al. ..... 362/363
5,526,243 A * 6/1996 Masters ..... 362/122
5,683,762 A * 11/1997 Banschick ..... 428/4
5,782,554 A * 7/1998 Huang ..... 362/294
5,918,964 A * 7/1999 Bou ..... 362/186

* cited by examiner

*Primary Examiner*—Sandra O'Shea
*Assistant Examiner*—Sharon Payne
(74) *Attorney, Agent, or Firm*—Reising, Ethington, Barnes, Kisselle, Learman & McCulloch, P.C.

(57) ABSTRACT

An artificial pumpkin stem apparatus that includes a stem portion with an attachment portion. There is also a mounting plate that includes a shaft-engaging portion. The shaft is connected to the attachment portion of the stem at a first end and is associated with the shaft-engaging portion of the mounting plate between the first and second ends of the shaft. A source of light may also be attached at the second end of the shaft.

18 Claims, 3 Drawing Sheets

5
15
35
75
80
90
60
25
85
20
10
30

ARTIFICIAL PUMPKIN STEM

This application claims priority to provisional patent application Ser. No. 60/196,691 filed Apr. 13, 2000.

FIELD OF THE INVENTION

The invention relates to an artificial pumpkin stem and light holder.

BACKGROUND OF THE INVENTION

Pumpkins are often carved in association with the celebration of Halloween within the United States. A common problem associated with carving pumpkins includes having the stem break off thereby, making removal of a carved lid more difficult. The use of an artificial that would not break off when the stem is grasped would thereby alleviate this problem.

Also, carved pumpkins or Jack-O-Lanterns are often illuminated using a candle or other such illumination means. Candles can pose fire risks, as well as, contaminate the flesh of the pumpkin with carving deposits. Such contamination would not allow the pumpkin to be utilized for food purposes or consumption after it has been displayed. It is known to use battery-operated lights that sit on the bottom of the interior carved-out portion of a pumpkin. Such lights may again pose a risk of contamination to the flesh of the pumpkin and the light is usually covered with material that is commonly associated with the interior of a carved pumpkin. The light therefore would need to be cleaned after such use.

Therefore, a light that could be associated with an artificial stem portion that would not sit on the bottom of the pumpkin, but would rather be associated with the carved lid and illuminate downwardly would be advantageous.

SUMMARY OF THE INVENTION

It is therefore an object of the present invention to cure those deficiencies outlined above and provide an artificial pumpkin stem and light that is both safe and economical.

The present invention concerns an artificial pumpkin stem apparatus that includes a stem portion having an attachment portion. There is also included a mounting plate that has a shaft engaging portion. Further included is a shaft that is connected to the attachment portion of the stem and a first end of the shaft, and the shaft also engages the shaft engaging portion of the mounting plate between the first and second ends of the shaft.

BRIEF DESCRIPTION OF THE DRAWINGS

Advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
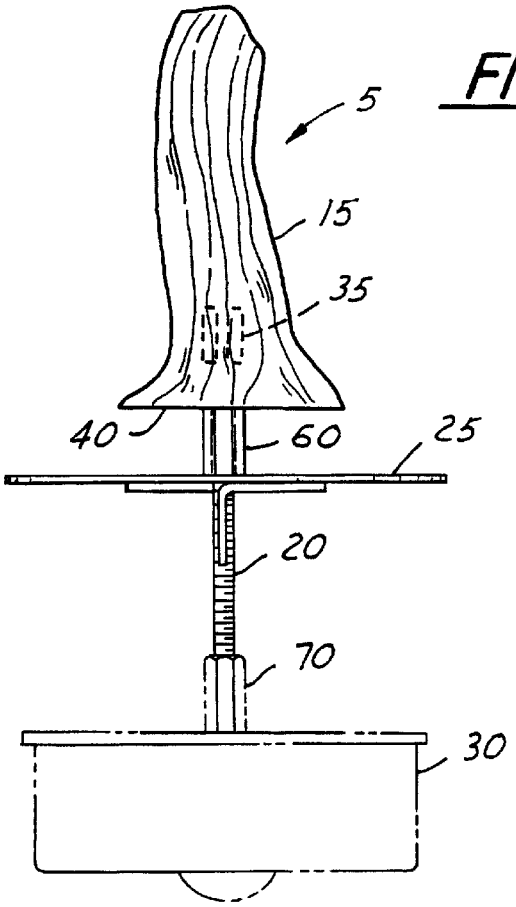
FIG. 1 is a front view of an artificial pumpkin stem and lightholder.
Figure 2:
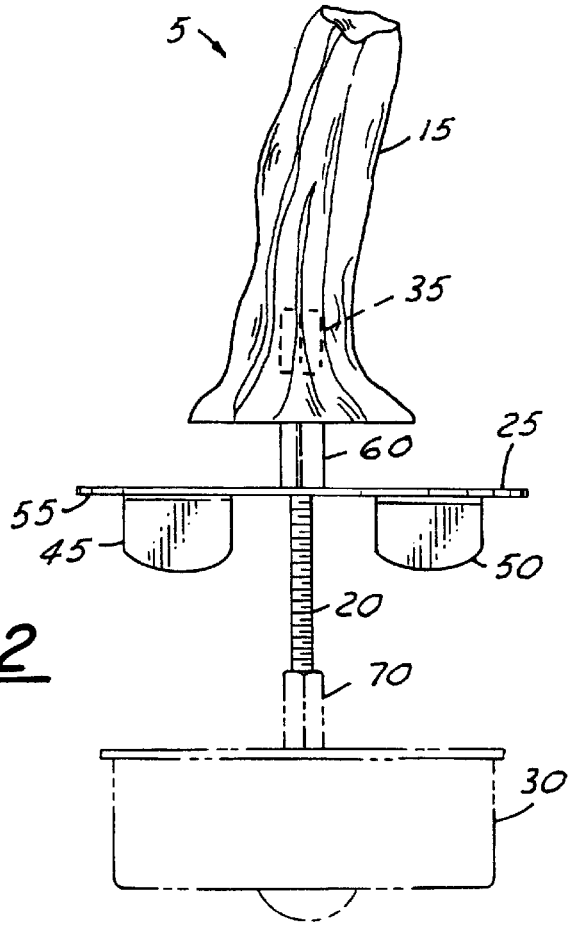
FIG. 2 is a side view of an artificial pumpkin stem and lightholder.
Figure 3:
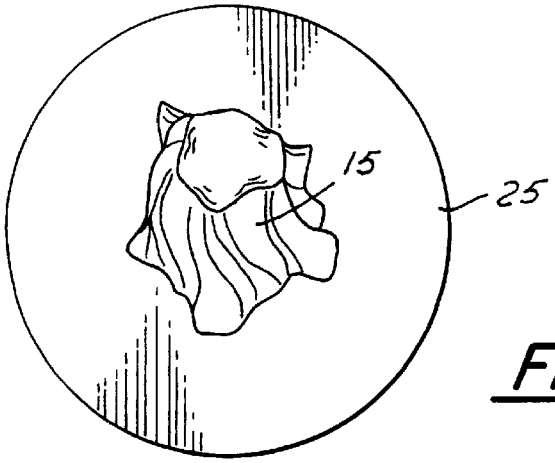
FIG. 3 is a top view of an artificial pumpkin stem and lightholder.
Figure 4:
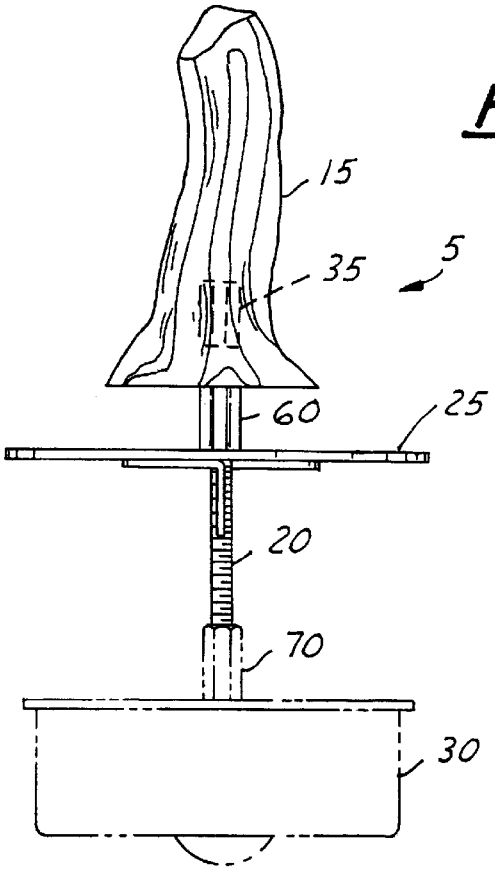
FIG. 4 is a side view of an artificial pumpkin stem and lightholder.
Figure 5:
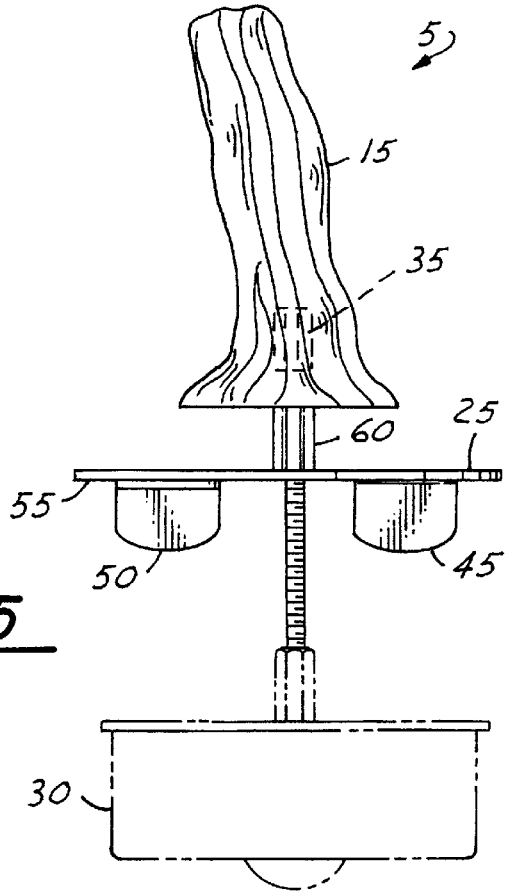
FIG. 5 is a rear view of an artificial pumpkin stem and lightholder.
Figure 6:
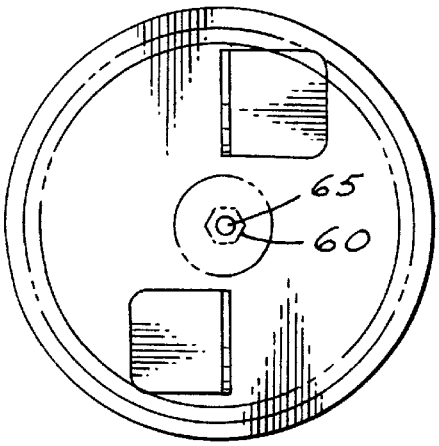
FIG. 6 is a bottom view of an artificial pumpkin stem and lightholder.
Figure 7:
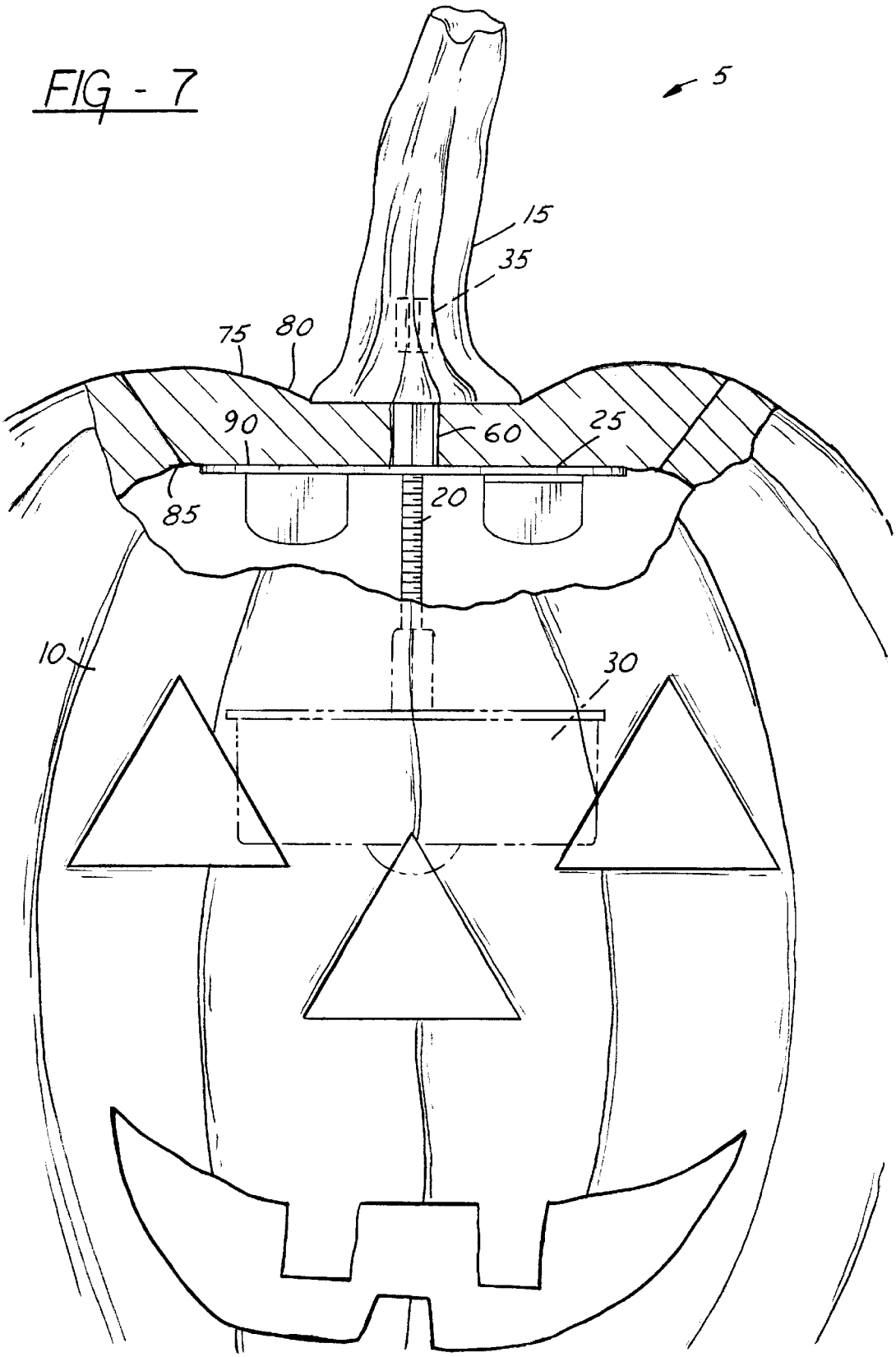
FIG. 7 is an enviromental view of an artificial pumpkin stem and lightholder.

Referring to the figures, wherein like numerals indicate like or corresponding parts throughout the several views, FIG. 7 generally shows an artificial pumpkin stem and lightholder apparatus 5 for detachable connection to a carved pumpkin 10.

The apparatus 5 includes a stem portion 15, a threaded shaft 20, a mounting plate 25 and a light 30.

The stem portion 15 is formed from an appropriate material such as plastic, wood, metal, ceramic, etc. to have the appearance of an actual pumpkin stem. In the depicted embodiment, the stem portion 15 has an asymmetrical shape having a plurality of ridges formed thereon to simulate the shape of a real pumpkin stem. The stem portion 15 may include a surface coating of paint or dye to add to the realistic appearance of the stem portion 15. The coloring may, alternatively, be integrally included with the stem portion; for example, color may be molded into a plastic during a thermal forming operation.

In the depicted embodiment, the stem portion includes an attachment portion 35 connected to the base 40 of the stem portion 15. The attachment portion 35 can be a hex nut, elongated nut, weld nut or other suitable attachment device. The attachment portion 35 can be connected to the base 40 of the stem portion 15 utilizing any appropriate methods, such as, adhesives, glues, welding, brazing, or molding the attachment portion 35 integrally with the stem portion 15 when manufacturing the stem portion 15.

The attachment portion 35 is adapted to receive a threaded shaft 20. The threaded shaft 20 may be permanently attached to the attachment portion 35, by gluing, soldering, brazing, or welding the shaft to the attachment portion 35. Alternatively, the shaft 20 may be removeably engaged by threading the shaft 20 into the attachment portion 35.

The mounting plate 25 is a substantially planar body made of a suitable material such as, metal or plastic. In the depicted embodiment, the mounting plate is circular in shape, but any suitable shape, such as, square, rectangular, oval, etc. can be utilized by the present invention. The mounting plate 25 includes a shaft engaging portion 60 to engage the shaft 20 as the mounting plate is tightened into position. The shaft engaging portion 60 is attached to the mounting plate 25 using any appropriate method, such as welding, brazing, gluing at a location on the plate 25 where a hole 65 is formed to allow passage of the shaft 20 through the plate 25. As with the attachment portion 35, the shaft-engaging portion 60 may be a hex nut, elongated nut, weld nut, or other suitable attachment device. Alternatively, threads may be formed on the inner walls of the hole 65 to mate with the shaft 20.

Also included on the mounting plate 25 are tabs 45 and 50 that are connected to the mounting plate 25 on the bottom surface 55 of the mounting plate 25. The tabs 45, 50 may be attached using any suitable method, such as, welding, brazing, soldering, or gluing. The tabs allow for the mounting plate 25 to be tightened when engaging the threaded shaft 20.

The apparatus 5 also includes a light 30 that has a similar light attachment portion 70 to that of the shaft engaging portion 60 and attachment portion 35. The light attachment portion 70 may be of a similar design as those previously outlined for the shaft engaging portion 60, and the attachment portion 35.

The light is battery operated and may be of any suitable design known in the art, as long as it has the appropriate attachment portion 70 for engaging the shaft 20. A suitable design of the light 30 should include a compartment for housing the batteries and appropriate circuitry as well as a lightbulb for emitting light into the interior of a pumpkin 10.

In use, the stem portion 15 is connected to the threaded shaft 20 via the attachment portion 35. The shaft 20 is then used to pierce the lid 75 of a carved pumpkin, which has had its real stem removed. The shaft 20 pierces the lid 75 from the exterior portion 80 of the lid 75 towards the interior portion 85 of the lid 75. The mounting plate 25 is then threadably engaged through the hole 65 by the shaft 20 and tightened using the tabs 45, 50 formed on the mounting plate 25. The mounting plate 25 is tightened until the plate is flush with the bottom surface 90 of the carved lid 75, and the stem portion 15 is securely positioned on the exterior portion 80 of the carved lid 75.

Once the stem portion 15 is secured, the light 30 may then be threadably connected to the shaft 20 via the light connecting portions 60.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claim, the invention may be practiced other than is specifically described.

What is claimed is:

1. An artificial pumpkin stem apparatus comprising:

a) a stem portion replacing a natural pumpkin stem, the stem portion including an attachment portion;

b) a mounting plate including a shaft engaging portion; and c) a shaft connected to said attachment portion of said stem at a first end of said shaft, and said shaft connected with said shaft engaging portion of said mounting plate between said first and a second end of said shaft.

2. The artificial pumpkin stem apparatus of claim 1 further including a light having a light attachment portion, the light attachment portion adapted to engage the shaft.

3. The artificial pumpkin stem apparatus of claim 2, wherein said shaft is connected to said light attachment portion at a second end of said shaft.

4. The artificial pumpkin stem apparatus of claim 3 wherein said shaft is releasably connected to said light attachment portion.

5. The artificial pumpkin stem apparatus of claim 1 wherein said shaft is permanently connected with said attachment portion of said stem portion.

6. The artificial pumpkin stem apparatus of claim 1 wherein said shaft has threads formed thereon.

7. The artificial pumpkin stem apparatus of claim 1 wherein said shaft is releasably connected with said attachment portion of said stem portion.

8. The artificial pumpkin stem apparatus of claim 1 wherein said shaft is releasably connected with said mounting plate.

9. The artificial pumpkin stem apparatus of claim 1 wherein said shaft engaging portion comprises a threaded opening.

10. The artificial pumpkin stem apparatus of claim 1 wherein said mounting plate includes tabs formed thereon for tightening said mounting plate connected to said threaded shaft.

11. An artificial pumpkin stem and light holding apparatus comprising:

a) a stem portion including an attachment portion;

b) a mounting plate including a shaft engaging portion;

c) a light including a light attachment portion; and d) a shaft connected to said attachment portion of said stem at a first end of said shaft, said shaft connected to said light attachment portion at a second end of said shaft, and said shaft connected with said shaft engaging portion of said mounting plate between said first and second ends of said shaft.

12. The artificial pumpkin stem apparatus of claim 11 wherein said shaft is permanently connected with said attachment portion of said stem portion.

13. The artificial pumpkin stem apparatus of claim 11 wherein said shaft has threads formed thereon.

14. The artificial pumpkin stem apparatus of claim 11 wherein said shaft is releasably connected with said attachment portion of said stem portion.

15. The artificial pumpkin stem apparatus of claim 11 wherein said shaft is releasably connected with said mounting plate.

16. The artificial pumpkin stem apparatus of claim 11 wherein said shaft engaging portion comprises a threaded opening.

17. The artificial pumpkin stem apparatus of claim 11 wherein said mounting plate includes tabs formed thereon for tightening said mounting plate connected to said threaded shaft.

18. An artificial pumpkin stem and light holding apparatus comprising:

a) a stem portion including an attachment portion positioned on an upper surface of a carved pumpkin lid;

b) a mounting plate including a shaft-engaging portion positioned on a lower surface of a carved pumpkin lid;

c) a light including a light attachment portion positioned in an interior of a carved pumpkin; and d) a shaft connected to said attachment portion of said stem at a first end of said shaft, said shaft connected to said light attachment portion at a second end of said shaft, and said shaft connected with said shaft engaging portion of said mounting plate between said first and second ends of said shaft.

* * * * *